US005318321A

United States Patent [19]

Dogat et al.

[11] Patent Number: 5,318,321

[45] Date of Patent: Jun. 7, 1994

[54] INTERFACE PIECE FOR THE SLIDE-RAIL BELONGING TO A BINDING, IN PARTICULAR AN ALPINE BINDING

[75] Inventors: Vincent Dogat, Annecy; Pascal Thomas, Chambery, both of France

[73] Assignee: Salomon S. A., France

[21] Appl. No.: 989,659

[22] Filed: Dec. 14, 1992

[30] Foreign Application Priority Data

Dec. 13, 1991 [FR] France ..... 15833

[51] Int. Cl.[5] ..... A63C 9/00

[52] U.S. Cl. ..... 280/633; 280/634

[58] Field of Search ..... 280/633, 634, 611, 632

[56] References Cited

U.S. PATENT DOCUMENTS 4,522,424 6/1985 Luitz et al. ..... 280/633
4,690,424 7/1987 Spitaler et al. ..... 280/633
5,102,158 4/1992 Erdie et al. ..... 280/633

FOREIGN PATENT DOCUMENTS 2647357 11/1990 France .

*Primary Examiner*—Richard M. Camby
*Attorney, Agent, or Firm*—Pollock, Vande Sande & Priddy

[57] ABSTRACT

An interface piece for the slide-rail of a binding, in particular an alpine binding. The slide-rail comprises a stationary base (6) attached to the ski and delimiting a slide-track (7), along which a movable element (3) is mounted in a sliding configuration. At least one end of the base is open, so as to allow engagement or disengagement of the movable element on the slide-track. An interface piece (18) is inserted between the slide-rail (6) and the upper surface of the ski, and is extended on the side of the open end of the base (6) and beyond this end, where it incorporates an elastically-retractable shoulder (21) positioned in alignment with the slide-track (7), so as to constitute an elastically-movable stop which, on this side, prevents the disengagement of the movable element (3) from the base (6).

9 Claims, 3 Drawing Sheets

INTERFACE PIECE FOR THE SLIDE-RAIL BELONGING TO A BINDING, IN PARTICULAR AN ALPINE BINDING

FIELD OF THE INVENTION

The invention concerns an interface piece for the slide-rail belonging to a binding, such as an alpine binding, and a binding equipped with this interface piece.

BACKGROUND OF THE INVENTION

In alpine skiing, a boot is held supported on a ski by means of a front and a rear binding. To adapt the ski to boots of different lengths, one of the bindings, normally the rear binding, incorporates a body which moves along a slide-rail and locking means making it possible to immobilize the body in a specific longitudinal position.

In the case of rental bindings, use is habitually made of slide-rails of significant length, so as to allow adaptation of the ski to a broad spectrum of users having boots of different lengths.

In this special case of rental bindings, the longitudinal position of the binding is very frequently adjusted. The person renting out the skis in fact performs an adjustment each time a different skier uses the skis. These adjustment operations must thus be made easily or rapidly. Advantage is also gained by limiting the backward movement of the body of the binding by means of a stop, in order not to risk accidentally detaching the body from the slide-rail during an adjustment operation, because of a violent movement or abrupt displacement of the body.

Moreover, advantage is gained when the binding can be disassembled, i.e., when the body can be taken off the slide-rail, which remains fastened to the ski, so as to allow cleaning or, potentially, replacement of the body.

Conventional rear bindings thus normally incorporate a slide-rail equipped with a stationary stop positioned toward the rear and have an open front end allowing the body to be detached.

The construction of the binding must thus reflect this constraint, and, in particular, nothing must hinder the release of the body at the front of the slide-rail, thereby giving rise to problems, notably as regards the brake.

There are also devices which have a stationary stop at the front and rear of the slide-rail, one of these stops being, for example, formed by a folded metal tongue. Using pliers, it is possible to untwist this tongue, so as to be able to take off the body. However, after several maneuvers, this tongue finally breaks, thus destroying the stop used to restrict the movement of the body.

SUMMARY OF THE INVENTION

One of the purposes of the present invention is to propose a construction in which a stop limits the motion of the body of the binding at each end of the slide-rail, and in which it also becomes possible to detach the body from the slide-rail repeatedly for purposes of cleaning or replacement. Thus, movement of the body along its slide rail can be restricted at each end of the latter. In other words, the construction of the binding is freed from constraints by virtue of which, for example, the body had to be detached from the front portion of the slide-rail. However, the invention makes it possible to detach the body from its slide-rail as desired, and to reinsert it onto the slide-rail without risk of damage to either of the stops.

One of the purposes of the present invention is to propose a construction which is particularly simple to produce and to use.

Other purposes and advantages of the invention will emerge during the following description.

The interface part for the slide-rail of a binding, such as an alpine binding, comprises a stationary base fastened to a ski and delimiting a slide track along which a movable component, such as the body of a binding, is mounted in a sliding arrangement, at least one of the ends of the base being open so as to allow the insertion of the movable element on the slide track or its detachment from that track. The interface component covers at least one part of the surface of the base externally to the slide-track of the base.

The interface component is extended toward the open end of the base and beyond this end, where it incorporates as elastically-retractable shoulder aligned with the slide track, so as to form an elastically-movable stop which, on this side, prevents the detachment of the movable element from the slide-rail.

BRIEF DESCRIPTION OF THE DRAWINGS

The invention will be better understood by virtue of the following description and of the attached drawings.

DESCRIPTION OF THE PREFERRED EMBODIMENT

Figure 1:
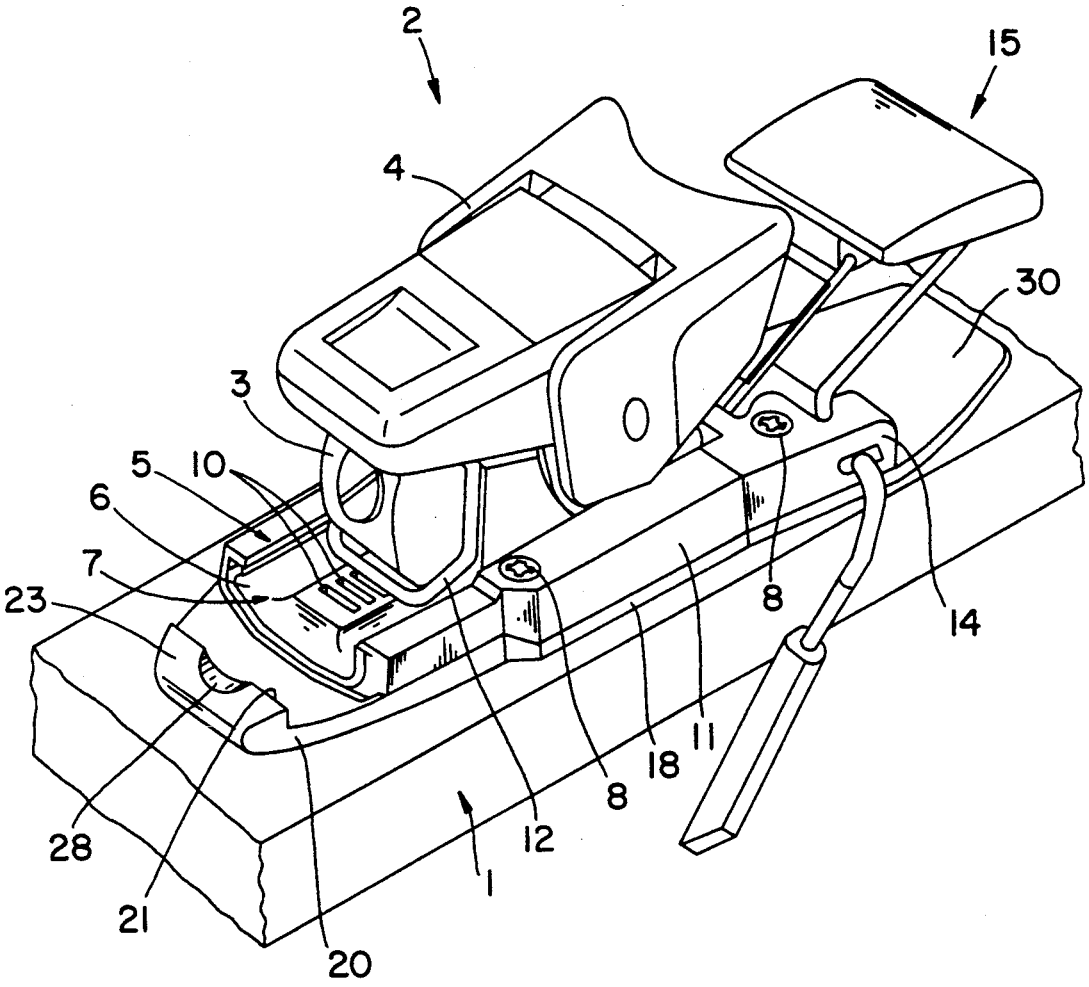
FIG. 1 is a perspective view of a binding equipped with an interface component according to one embodiment of the invention.

FIG. 1 shows a partial view of a ski 1 to which a rear binding 2 is assembled. This rear binding comprises a body 3, which carries a device 4 for holding the rear end of the boot in position.

The body 3 is mounted so as to slide along a slide-rail 5 comprising a stationary base 6 which, in the example shown, is a sheet-metal piece in the shape of a "C" lying on its side and open at the top. This base 6 delimits a slide track 7 swept by the body of the binding during its longitudinal movements.

In the example shown, the base 6 is open at its rear end, i.e., no component belonging to the base opposes detachment of the body 3 from the slide-rail at this end.

The front end of the base 3 is also open in the embodiment shown; however, this is of no importance, since a stop to be described below restricts the motion of the body in this area.

Moreover, conventional means (not shown in detail in FIG. 1) make it possible to immobilize the body 3 in predetermined positions along the base 6. These means comprise, for example, a locking mechanism which moves with the body 3 and which is equipped with teeth engaging in slots 10 in a rack which the base 3 incorporates in its central portion. In the example illustrated, a loop 12 located in the rear part of the body allows operation of the locking mechanism between a low position, in which its teeth are engaged in orifices 10 in the base 6, and a high position, in which the teeth are released from the base 6, i.e., in which the body can be moved along the base 6.

This device is described in applicant's French Patent Application No. 91 01481. These locking means are not, however, restrictive, and any other suitable means, can be used. However, these locking means are preferably of the locking mechanism type, i.e., a device having distinct locked and unlocked positions in relation to the base 3.

In the example illustrated in FIG. 1, the base 6 is enclosed by a first sheathing piece 11 which covers it over substantially its entire length and over its lower surface and lateral edges. The sheathing piece 11 leaves the rear end of the base 6 and the slide track 7 free. Advantageously, the sheathing piece 11 has means for holding the assembly screws 8 in place on the binding, until they are screwed into the ski.

The base 6 and the sheathing piece 11 are extended at the front so as to constitute the base plate 14 of a brake 15. In the example shown, the base plate 14 of the brake 15 is fastened to the ski in the same manner as the base. The components of this base plate 14 constitute a forward-motion stop for the body during its longitudinal movements. In effect, they prevent the body 3 from disengaging from the base.

As shown in FIG. 1, an interface piece 18 is inserted between the first sheathing piece 11 and the upper surface of the ski 1. Beneath the sheathing piece, the interface piece has a main part whose thickness is substantially constant and whose shape, seen from above, is substantially the same as that of the sheathing piece 11. In particular, the central part of the interface piece 18 raises the base 6 in relation to the ski on the side of its open end.

The interface piece 18 further incorporates a rear part 20 shaped like an elastic tongue which can be elastically retracted toward the upper surface of the ski. In the embodiment illustrated, the interface piece 18, i.e., its main section and its rear part 20, form a one-piece assembly, and the piece is made of an elastically-deformable plastic material.

Figure 2:
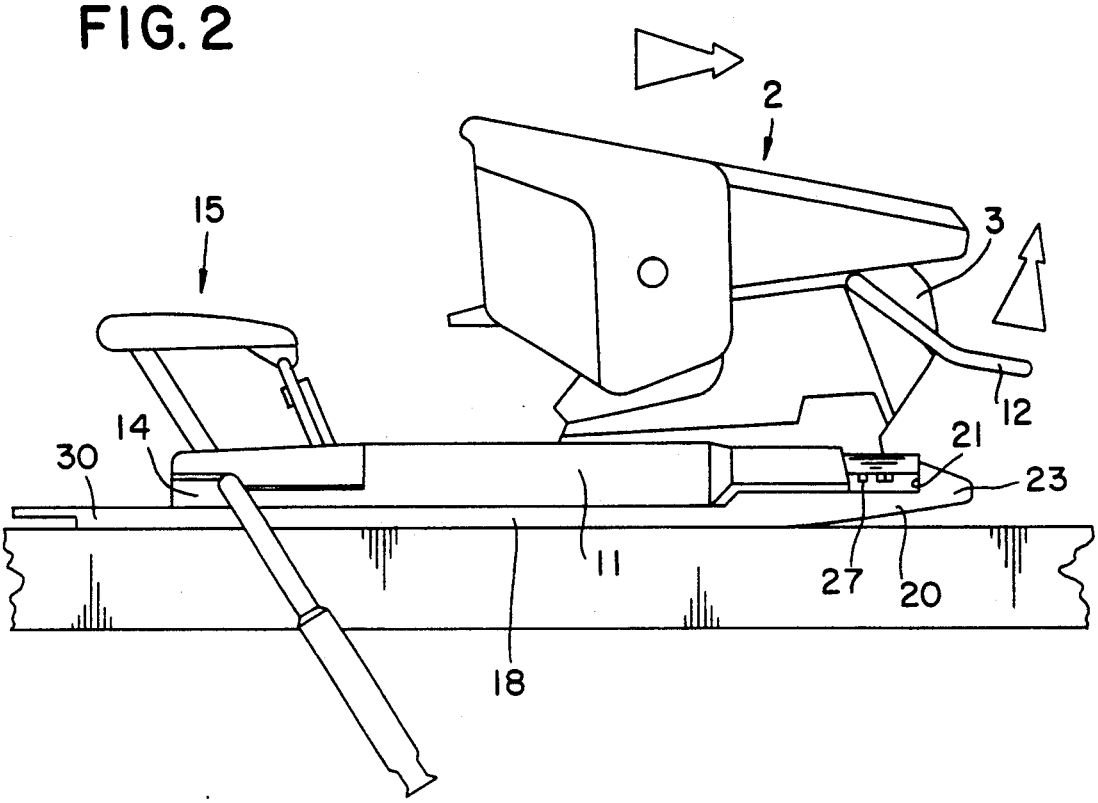
FIG. 2 is a side view of the device in FIG. 1.

The rear part 20 extends beyond the rear end of the slide-rail 6 and incorporates, in this area, a shoulder 21 positioned in the alignment of the slide-track 7 on the base 6. The shoulder 21 forms a stop limiting the backward movement of the body 3. FIG. 2 represents the body 3 in its extreme rearward position, reached after the loop 12 has swung upward so as to release the locking mechanism, followed by rearward movement of the body.

The shoulder 21 is sufficiently offset to the rear in relation to the slide-rail not to hinder the elastic backward travel of the body during skiing, when the body is in the extreme rear position on the slide-rail.

In addition, in the embodiment illustrated in FIG. 2, in which the body is stopped against the shoulder 21 of the interface piece 18, the teeth of the locking mechanism (diagrammed at 27), which allow immobilization of the body, are disengaged completely from the base 6, i.e., the body is no longer engaged on the base 6 by means of the locking mechanism.

As shown in FIG. 2, the rear part 20 of the interface piece 18 is bevelled, i.e., its lower surface rises to the rear and upward. Since this rear part 20 is elastically deformable, it can be lowered toward the ski by a voluntary movement, so as to retract the shoulder 21 and remove it from alignment with the slide-track 7.

The fact that the rear part is raised in relation to the upper surface of the ski advantageously makes it possible not to impair ski flection in this area.

Figure 3:
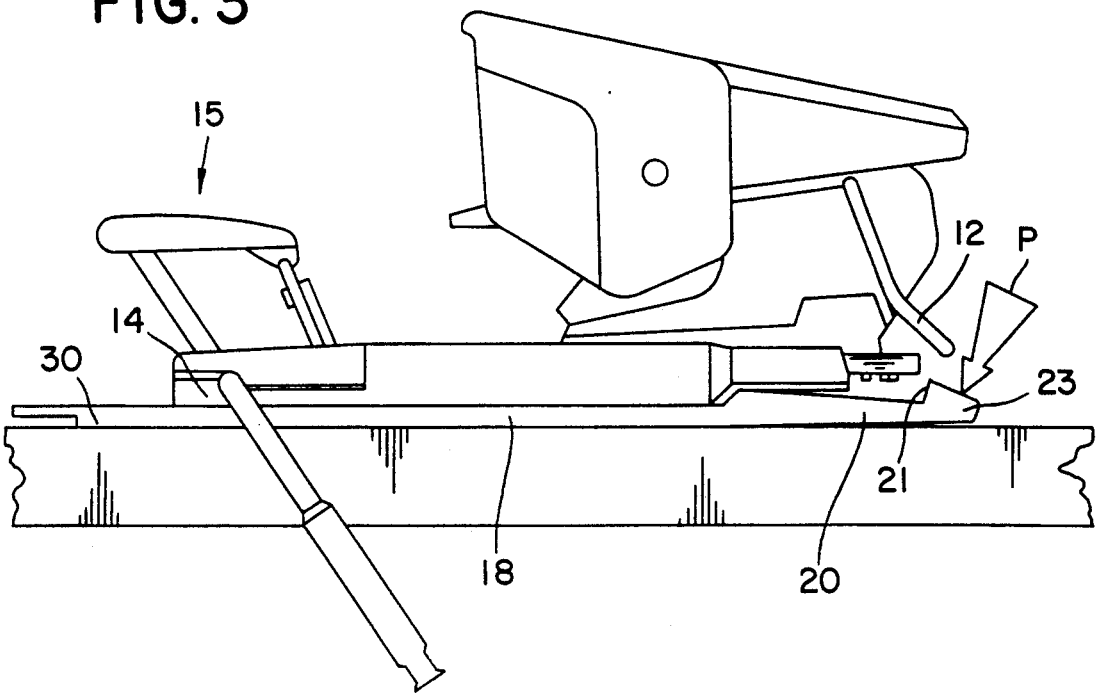
FIG. 3 is a front elevation view similar to that in FIG. 1, illustrating the operation of the locking device according to the invention.

FIG. 3 shows the interface piece 18 in this position. A force (indicated by the arrow "P") has been exerted on the rear end of part 20, and this force has deformed the rear part 20 toward the upper surface of the ski. The shoulder 21 is thus lowered, thereby permitting free backward movement of the body which makes it possible to detach the body from the slide-rail. At this stage, no action on the locking mechanism or on the loop 12 is required, since, as stated earlier, in the stopped position against the shoulder 21, the teeth 23 of the locking mechanism are disengaged from the slide-rail.

Inversely, to engage the body 3 on the slide-rail, one need only position the lower part of the body at the rear opening of the base 6, then exert downward pressure on the body so as to place its lower part in alignment with the slide-track 7 on the base, a maneuver which simultaneously exerts pressure on the rear part 20 of the interface piece 18 and retracts the shoulder 21 downward.

Given the elastically-deformable nature of the interface piece 18, or at the very least of its rear section, as soon as this downward pressure on the rear part 20 ceases, this part returns to its raised position, thereby bringing the shoulder 21 back into alignment with the slide-track 7 of the base 6. The shoulder 21 thus acts, once again, as a stop which limits the backward movement of the body along the slide-rail.

In the embodiment illustrated in FIGS. 1 to 3, the rear part 20 of the interface piece incorporates, beyond the shoulder 21, a rearward extension 23 which a skier can press with one finger or with a tool. This extension 23 may incorporate a recessed impression designed to receive the blade of a tool, such as a screwdriver.

Figure 4:
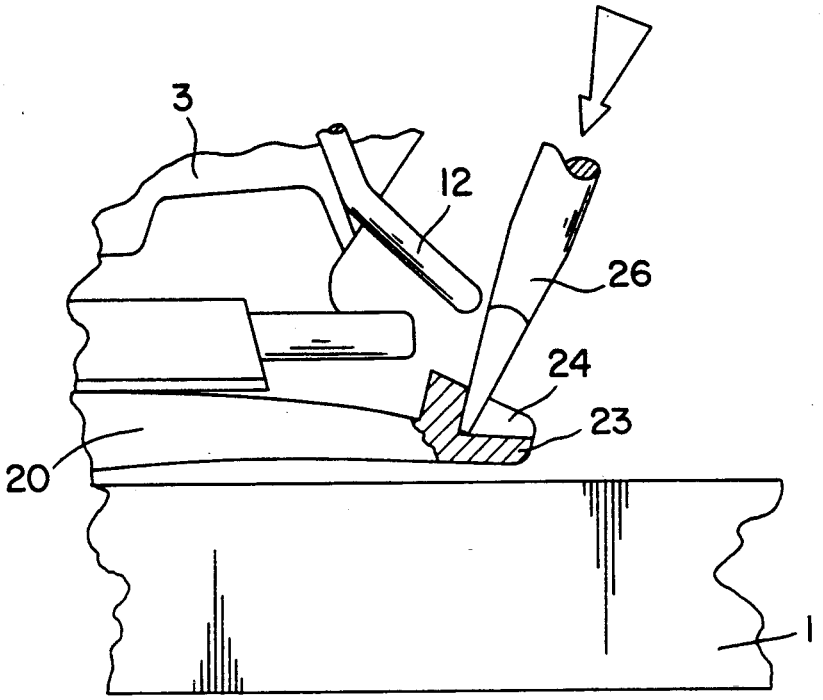
FIG. 4 illustrates one variant of the interface part.

FIG. 4 is a cross-section view showing this impression 24, inside of which the blade 26 of a tool can be inserted.

Figure 5:
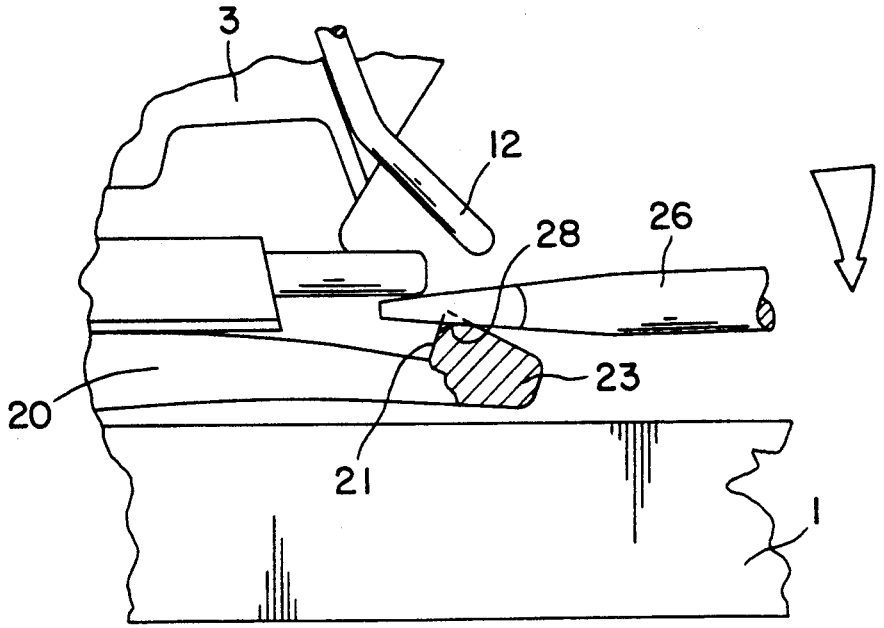
FIG. 5 illustrates another embodiment.

FIG. 5 illustrates another variant in which the tool 2 is engaged beneath the body 3 of the binding and pivoted downward while resting on a cavity 28 in the central portion of the extension 23. The pivoting motion retracts the shoulder 21 downward, thereby allowing disengagement of the body from the base.

The lower part of the body delimits a relatively flat surface, so that a part of the body need only be engaged above the shoulder 21 to hold the shoulder in the retracted position and allow the total detachment of the body, or, during the inverse operation, its engagement.

It is also possible for the tool to be engaged laterally or supported beneath the base 6 of the slide-rail.

According to one preferred embodiment, in the case of a rear binding, the interface plate 18 is extended toward the front end and beyond the base, i.e., beyond the base plate 14 of the brake, by means of a kind of tongue 30. This tongue is sized in such a way that, when the boot is inserted in the binding, the brake pedal rests on it. This makes it possible to control more effectively the retraction of the brake. Furthermore, the ski is protected in this area from damage that could result from friction of the brake pedal.

The sheathing piece 11 is not indispensable, and the base could be placed directly in contact with the interface piece 18. According to another variant, the sheathing piece 11 and the interface piece 18 could form a one-piece assembly. In addition, the interface piece could be equipped with temporary means of attachment to the rest of the binding, e.g., by clamping, so as to hold the interface piece in pace beneath the slide-rail until assembly of the binding to the ski. Finally, it is evident that the invention is also applicable to a front binding and, generally speaking, to any accessory of which one part can travel along a slide-rail fastened to a sliding board, in particular an alpine ski, a cross-country ski, a surfboard, or a water-ski.

What is claimed is:

1. Interface piece for the slide-rail of a binding, said slide-rail comprising a stationary base (6) fastened to a ski and delimiting a slide-track (7) along which a movable element, such as the body (3) of a binding, is mounted for sliding movement, at least one end of said base being open in order to allow engagement and disengagement of said movable element on said slide-track, said interface piece (18) covering at least one portion of a surface of said base outside of said slide-track on said base, wherein said interface piece (18) has, on the side of the open end of said base and beyond said end, an elastically-retractable shoulder (21) positioned in alignment with said slide-track (7), so as to constitute an elastically-movable stop preventing, on said side, disengagement of said movable element from said slide-rail.

2. Interface piece according to claim 1, comprising a main part having a predetermined thickness located beneath said base (6) so as to raise at least said open end of said base (6) in relation to the upper surface of the ski, and which is extended beyond said open end of said base by means of a rear part (20) carrying said retractable shoulder (21).

3. Interface piece according to claim 2, wherein, on the side of the open end of said base, said piece is shaped like a tongue (20) which is elastically deformable in the direction of the ski, on the upper surface of which a shoulder (21) forming said movable stop is positioned.

4. Interface piece according to claim 3, wherein said tongue (20) and said main part form a one-piece assembly.

5. Interface piece according to claim 3, made of an elastically deformable material.

6. Interface piece according to claim 1, wherein, beyond said shoulder (21), said piece incorporates an extension (23) which a skier can press in order to lower the shoulder toward the upper surface of the ski.

7. Interface piece according to claim 1, wherein said piece incorporates a shoulder (24) in proximity to said shoulder (21), in order to allow insertion of a blade of a tool.

8. Interface piece according to claim 1, wherein said piece extends beneath the entire length of said slide-rail (5) and is extended by means of a tongue (30) beyond the end opposite said open end of said slide-rail (5).

9. Binding designed to hold a boot supported on a ski, comprising a body which moves along a slide-rail (5), said binding comprising an interface piece (18) according to claim 1 which is inserted between said slide-rail (5) and an upper surface of the ski.

* * * * *